US006755686B2

(12) United States Patent
Scherer et al.

(10) Patent No.: US 6,755,686 B2
(45) Date of Patent: Jun. 29, 2004

(54) PLUG-IN CONNECTION

(75) Inventors: August Scherer, Dinkelscherben (DE); Siegfried Renner, Graben (DE); Werner Luplow, Kissing (DE)

(73) Assignee: Fujitsu Siemens Computers GmbH, Munich (DE)

( * ) Notice: Subject to any disclaimer, the term of this patent is extended or adjusted under 35 U.S.C. 154(b) by 0 days.

(21) Appl. No.: 10/182,698

(22) PCT Filed: Feb. 23, 2001

(86) PCT No.: PCT/DE01/00705

§ 371 (c)(1),
(2), (4) Date: Nov. 12, 2002

(87) PCT Pub. No.: WO01/69729

PCT Pub. Date: Sep. 20, 2001

(65) Prior Publication Data

US 2003/0092315 A1 May 15, 2003

(30) Foreign Application Priority Data

Mar. 17, 2000 (DE) ..... 100 13 171

(51) Int. Cl.[7] ..... H01K 13/73
(52) U.S. Cl. ..... 439/564; 439/939
(58) Field of Search ..... 439/607, 609, 439/939, 564

(56) References Cited

U.S. PATENT DOCUMENTS 5,288,244 A * 2/1994 Lien ..... 439/362
5,975,953 A * 11/1999 Peterson ..... 439/607
6,066,003 A * 5/2000 Chang ..... 439/607
6,135,815 A * 10/2000 Ko et al. ..... 439/607
6,176,728 B1 * 1/2001 Bonnet et al. ..... 439/362
6,190,204 B1 * 2/2001 Huang ..... 439/607

FOREIGN PATENT DOCUMENTS

| | | |
|---|---|---|
| DE | G 85 01 658 6 | 5/1985 |
| DE | 692 07 993 T2 | 6/1996 |
| DE | 197 42 458 C1 | 11/1998 |
| EP | 0 887 894 A2 | 12/1998 |

* cited by examiner

*Primary Examiner*—Neil Abrams
*Assistant Examiner*—Phuong K Dinh
(74) *Attorney, Agent, or Firm*—Cohen, Pontani, Lieberman & Pavane

(57) ABSTRACT

The invention relates to a plug-in connection between a printed-board connector (3) and a mating connector (13), said printed-board connector (3) being provided with a connector shield (6). Between the printed-board connector and the mating connector an I/O board (1) with an opening (2) is interposed via which the printed-board connected and the mating connector can be contacted and fastened to each other. Since the printed-board connector is not screwed together with the I/O board according to the most recent standard, a support element is provided which forces the I/O board (1) against the connector shield (6) of the printed-board connector (3) when the mating connector (13) is screwed together with the printed-board connector (3).

12 Claims, 4 Drawing Sheets

PLUG-IN CONNECTION

Figure 1:
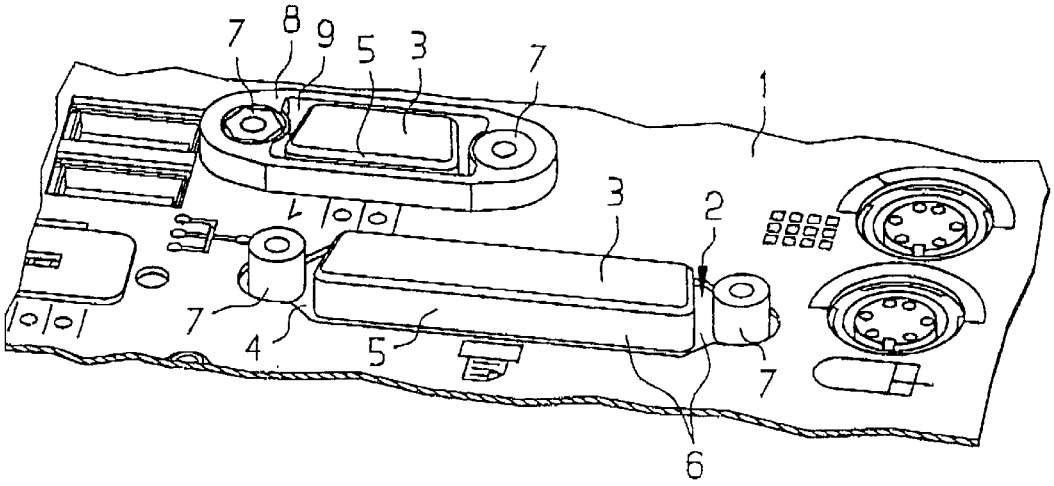

The invention pertains to a plug connection between a printed circuit board connector and a mating connector, wherein the printed circuit board connector has a connector shielding e.g. of the shielding-plate type or a metallizing coating and wherein an I/O plate located between the printed circuit board connector and the mating connector is provided with an opening through which the printed circuit board connector and the mating connector can make contact and can be firmly connected to each other by means of threaded bolts and screws.

As a rule, such plug connections occur in PCs, the printed circuit board connector being arrayed on a component card or on the motherboard and the mating connector on a cable which is connected to the printer, to the mouse, to the monitor, or to some other external component.

As a rule, the I/O plate represents the back panel of the PC, serving both as a back wall for the case and as a connector shielding against electromagnetic impact.

To achieve optimal electromagnetic compatibility, it is important for the connector shielding on the printed circuit board connector to be in conductive contact with the I/O plate, so that a grounding contact is achieved.

To date, this has been accomplished by inserting the printed circuit board connector with its connector shielding through an opening in the I/O plate and then screwing it in place via threaded bolts inserted from the other side through separately drilled holes in the I/O plate next to the opening. By means of the separate threaded bolts, screwed into the printed circuit board connector from the other side of the I/O plate, the printed circuit board connector with its connector shielding was pulled against the I/O plate, so that a good contact between the connector shielding of the printed circuit board connector and the I/O plate was certain to come about.

In the generic embodiment in accordance with the new standard, the threaded bolts are already attached to the printed circuit board connector and the opening in the I/O plate is of a size permitting the connector shielding of the printed circuit board connector, which protrudes forward in shroud fashion, to be inserted through the opening together with the threaded bolts arrayed on the printed circuit board connector.

While the new standard significantly facilitates assembly, the threaded bolts do not achieve secure contact between the connector shielding of the printed circuit board connector and the I/O plate.

Depending on the dimensional tolerances of the printed circuit board and the placement tolerances of the printed circuit board connector on the printed circuit board, the contact made by the connector shielding of the printed circuit board connector and the I/O plate is either poor or non-existent. Even when a mating connector is plugged in, no secure contact between the connector shielding of the printed circuit board connector and the I/O plate is assured, as the mating connectors are all standardized and are merely plugged onto the printed circuit board connector and screwed into place by means of the threaded bolts.

Instead, there is a danger that the force exerted when the mating connector is plugged in will bend the printed circuit board connector inward, so that secure contact between the connector shielding of the printed circuit board connector and the I/O plate is prevented. Moreover, the connection between the printed circuit board connector and the printed circuit board is severely stressed, as the entire exerted plug-in force is transferred to this connection.

While the new standard, according to which the printed circuit board connectors with the threaded bolts are inserted through a single opening in the I/O plate, entails the advantage that the threaded bolts no longer have to be screwed separately into the printed circuit board connector, the secure contact between the connector shielding of the printed circuit board connector and the I/O plate is lost, and the plug-in forces are transferred to the connection between the printed circuit board connector and the printed circuit board.

The invention is therefore based on the task of further developing the generic plug connection as provided under the new standard, such that without infringement of the new standard a secure contact between the connector shielding of the printed circuit board connector and the I/O plate is achieved.

In accordance with the invention, this task is met by the provision of a support device which, when the mating connector is screwed into the printed circuit board connector, will support the mating connector at the I/O plate, thus pulling the connector shielding toward the I/O plate at the printed circuit board connector.

As is the case in the standard, the threaded bolts are preferably arrayed on the printed circuit board connector and the screws on the mating connector, and the threaded bolts are inserted through the opening in the I/O plate. Preferably, the printed circuit board connector has a connector shielding which is both tabular and shroud-style (Sub-D) and either in the form of a metal shielding plate or a metallized plastic, and that part of it which projects in the direction of the plug-in motion being inserted through the opening in the I/O plate.

For example, the support device may be embodied as a distance piece which can be set upon the the threaded bolts inserted through the I/O plate and which, when screwed into place, will be propped on the I/O plate on one side and on the mating connector on the other side.

The distance piece may be provided for each threaded bolt, or it may be embodied as a single piece, the latter embodiment variant requiring an insertion opening for making contact between the printed circuit board connector and the mating connector.

The distance piece(s) is/are preferably designed so as to be held in place in a self-clamping manner upon being set onto the threaded bolt.

Most appropriately, the distance piece is made of plastic, but for additional contact it can also be made of a conductive material such as metal.

In accordance with an alternative type of embodiment, the support device is connected to the I/O plate. It is preferably formed integral with the O/O plate and, for example, is created by brackets bent outward at a 90° degree angle on the sides of the opening.

In accordance with a third type of embodiment, the support device is shaped as part of the case of the mating connector, such that the mating connector's face rests on the I/O plate upon completion of the screwed connection.

Below, the invention is explained in detail by reference to the embodiment variants shown in the drawings.

The drawings represent, in

Figure 2:
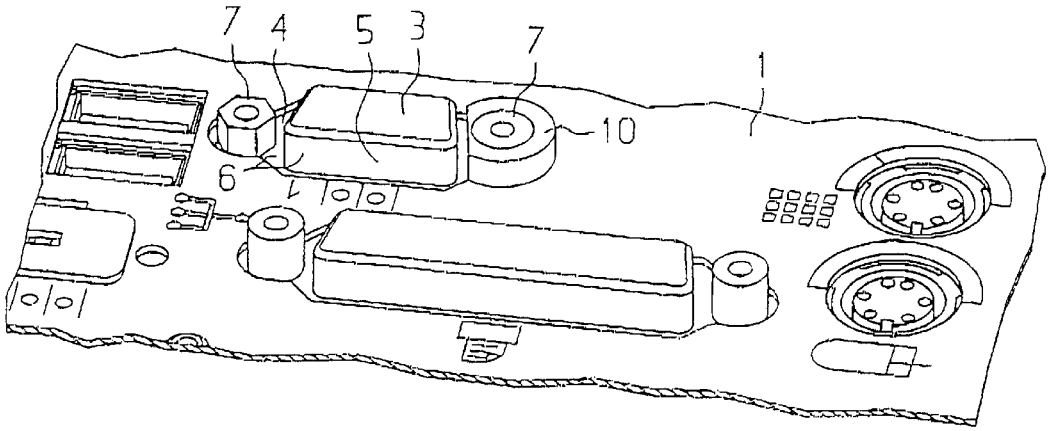
Figure 3:
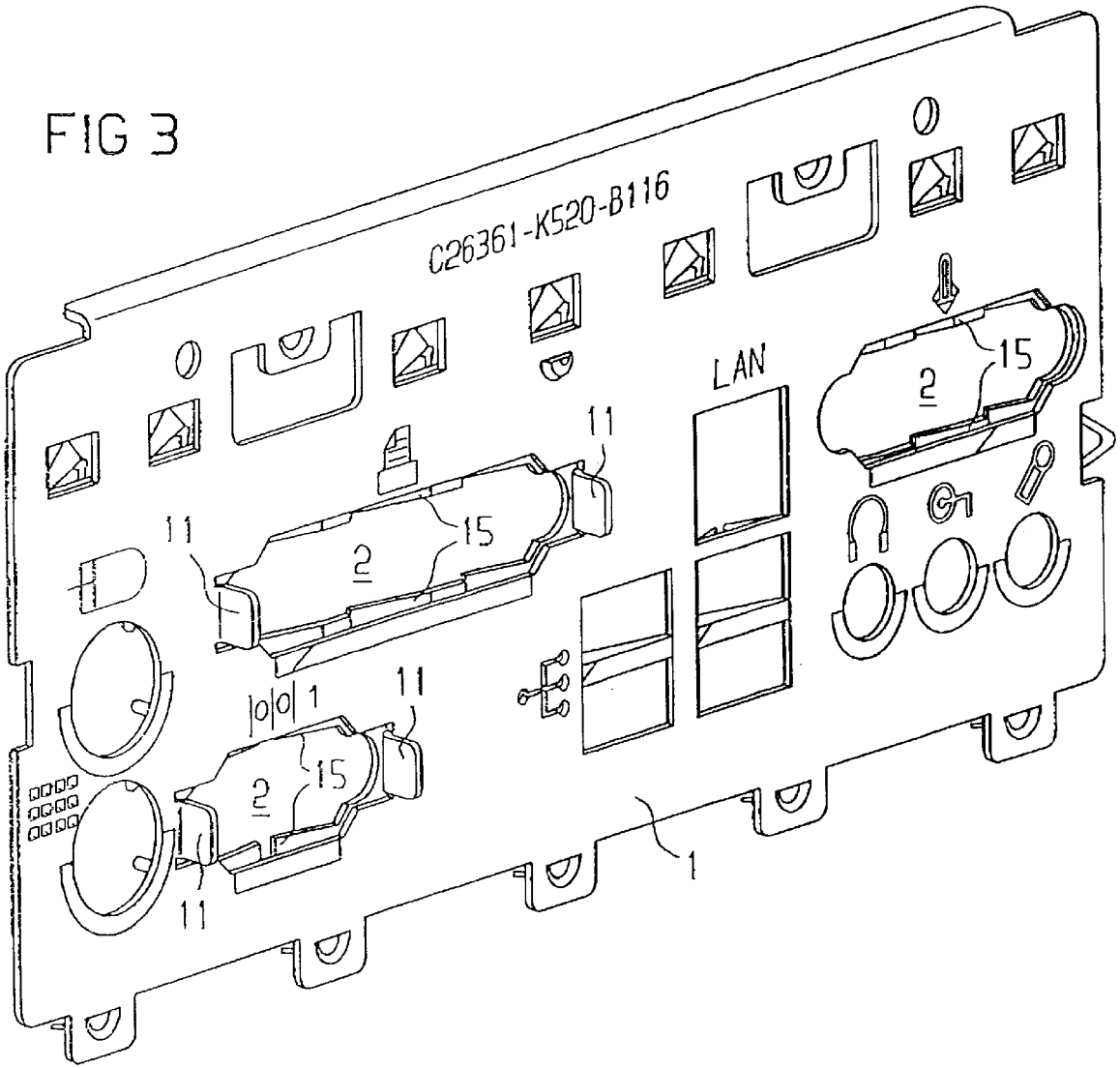
Figure 4:
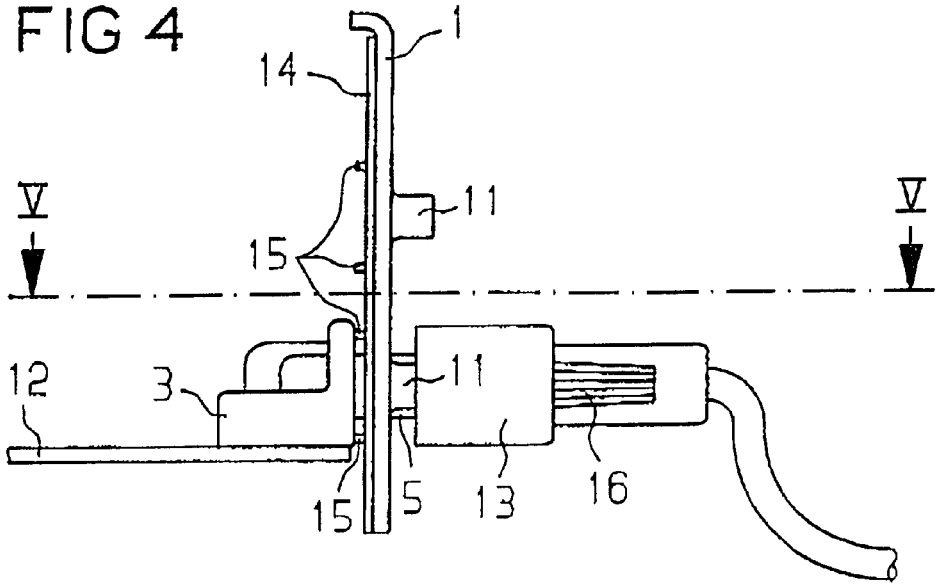
Figure 5:
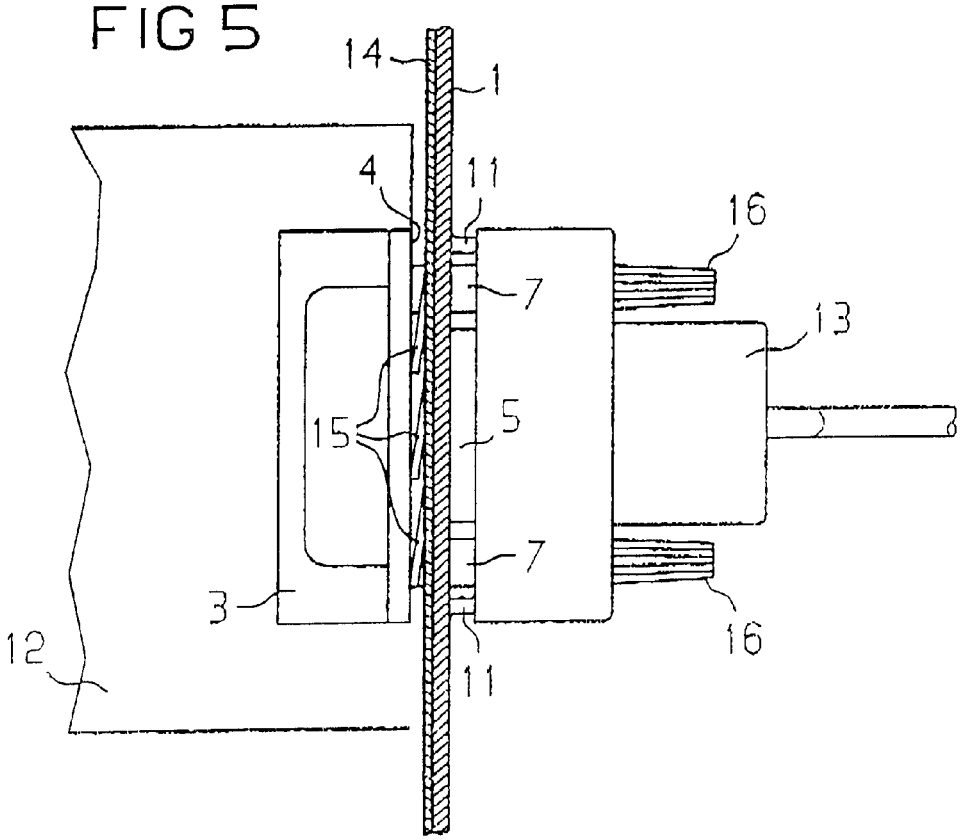
Figure 6:
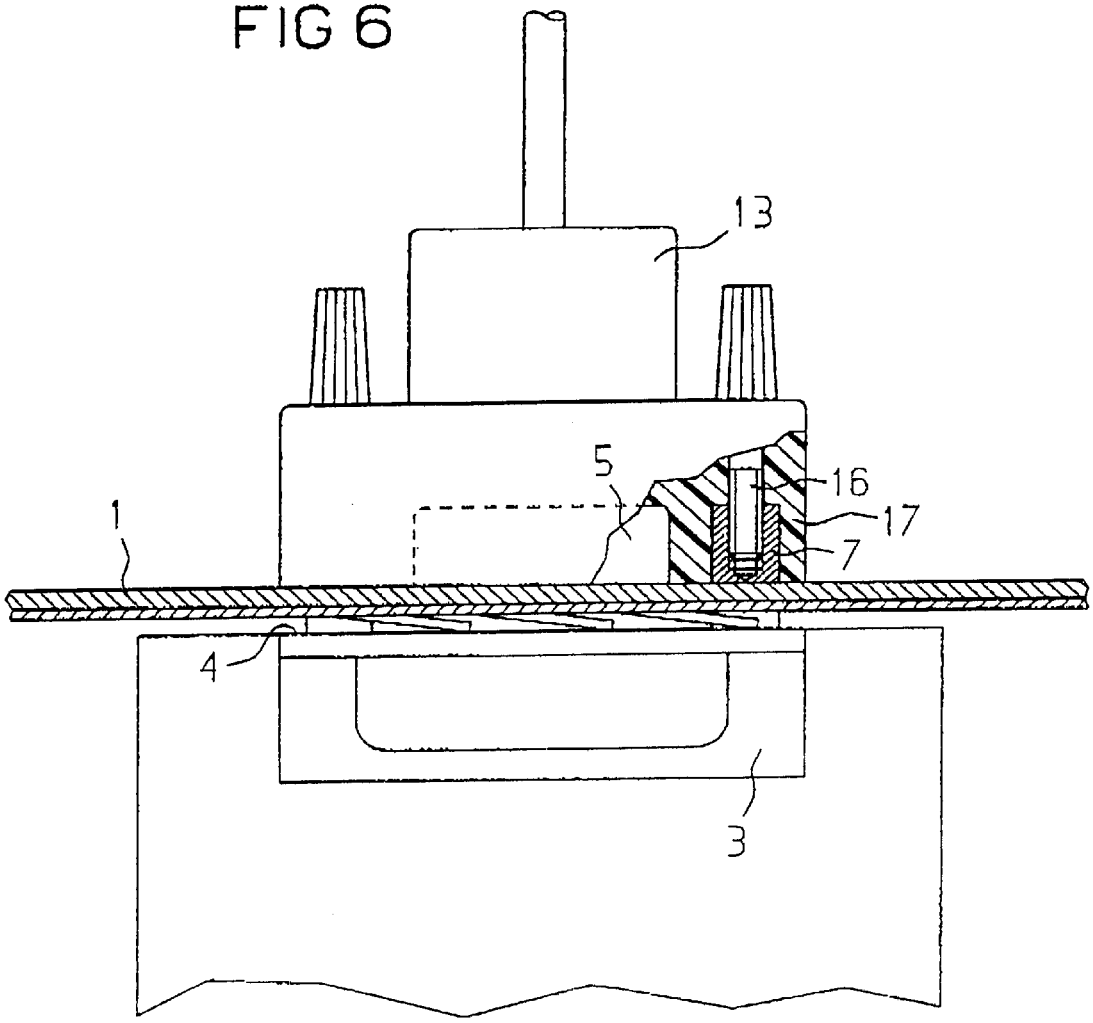

FIG. 1 a diagonal view of an I/O plate with inserted printed circuit board connectors and one-piece distance piece set upon them, FIG. 2 the view in accordance with FIG. 1, with one distance piece on one threaded bolt, FIG. 3 a diagonal view of an I/O plate with support devices in the form of vertically extended brackets, FIG. 4 the side view of the I/O plate in accordance with FIG. 3 with printed circuit board connector and mating connector plugged together, FIG. 5 section V—V from FIG. 4, and FIG. 6 the plug connection in accordance with the invention, with a support device integrated with the mating connector.

FIG. 1 shows in diagonal view an I/O Plate 1 already constructed in accordance with the new standard and having Printed Circuit Board Connectors 3 inserted from the back of I/O Plate 1 through appropriate Openings 2. The Printed Circuit Board Connectors 3 have a Front Surface 4 which touches the back of I/O Plate 1, as well as a Projection 5 arrayed thereon pointing in the plug-in direction and projecting through the Opening 2 in I/O Plate 1.

Both Front Surface 4 and Projection 5 of Printed Circuit Board Connectors 3 are provided with a Connector Shielding 6, wherein the connector shielding may consist of a metal shielding plate or of metallized plastic.

This type of plug is commonly known as sub-D connector.

Threaded Bolts 7, likewise inserted through Opening 2 of I/O Plate 1, are permanently connected to Printed Circuit Board Connector 3 on Front Surface 4 of Printed Circuit Board Connector 3.

If a mating connector is plugged into Printed Circuit Board Connector 3 as the latter is shown in FIG. 1 in the lower position, the danger arises that Printed Circuit Board Connector 3 is pressed backward and contact between Connector Shielding 6 and I/O Plate 1 is thus interrupted.

Likewise, imprecise dimensions of the printed circuit board on which the printed circuit board connector is mounted may inherently result in a distance between Front Surface 4 and the back of I/O Plate 1.

The standardized mating connectors are either plugged into the shroud-type Projection 5 or placed over Projection 5 with their shielding plate and merely screwed in place by Threaded Bolts 7.

In order to press I/O Plate 1 against Front Surface 4 of Printed Circuit Board Connector 3 while screwing the mating connector and Printed Circuit Board Connector 3 together, a support device in the form of a Distance Piece 8 is provided which is placed upon the Threaded Bolts 7 inserted through Opening 2 of the I/O Plate, as shown for the upper Printed Circuit Board Connector 3.

In accordance with this embodiment example, Distance Piece 8 is in one piece and possesses an Insertion Opening 9 for the shroud-type Projection 5 of Printed Circuit Board Connector 3. The height of Distance Piece 8 is appropriate for pressing I/O Plate 1 against Front Surface 4 of Printed Circuit Board Connector 3 when the mating connector is screwed together with the printed circuit board connector.

FIG. 2 shows the view in accordance with FIG. 1, wherein one Distance Piece 10 is provided as a support piece for each Threaded Bolt 7.

As represented in FIG. 2, Distance Piece 10 has only been placed on one Threaded Bolt 7 at the upper Printed Circuit Board Connector 3, whereas a Distance Piece 10 is actually placed on both Threaded Bolts 7 to make the plug connection.

FIG. 3 shows an I/O Plate 1 with three Openings 2 for Printed Circuit Board Connectors 3 of the Sub-D type.

In the two Openings 2 shown on the left in FIG. 3, the support devices for propping the mating connector take the form of Brackets 11 which are manufactured in one piece with the I/O Plate and bent at a 90° angle at the sides of the Openings 2 in the direction from which the mating connector comes when being plugged in.

Brackets 11 may also be riveted or welded to the I/O plate.

FIG. 4 shows a plug connection with I/O Plate 1 in accordance with FIG. 3 in side view. The Printed Circuit Board Connector 3 is mounted on a Printed Circuit Board 12 and connected to an appropriate Mating Connector 13 through Opening 2 in I/O Plate 1.

In the illustrated embodiment variant, a Spring Band 14 is additionally arrayed on I/O Plate 1 at the side of the Printed Circuit Board Connector 3, Spring Band 14 having Spring Lamellae 15 projecting in the direction of the printed circuit board connector in the area of Openings 2. Spring Lamellae 15 are also visible in FIG. 3.

FIG. 5 represents section V—V from FIG. 4.

Via Screws 16 on Mating Connector 13, which are screwed into the Threaded Bolts 7 of Printed Circuit Board Connector 3, Printed Circuit Board Connector 3 is pulled toward Spring Lamellae 15 of Spring Band 14 with its Front Surface 4 and thus with its metallic Connector Shielding 6, since the Mating Connector 13 is held in place by Brackets 11 of I/O Plate 1.

FIG. 6 shows an additional embodiment of the invention, wherein all identical elements are identified by the same reference symbols as in the preceding embodiments. It represents a partial side view of the plug connection with a partial section at the mating connector in the area of the screw connection.

In accordance with this embodiment, Mating Connector 13 has a support device integral to the housing of Mating Connector 13 and shaped as a Shroud 17. Shroud 17 is shaped in a manner allowing it to receive Threaded Bolts 7 of Printed Circuit Board Connector 3 and to prop its front against I/O Plate 1 when the Threaded Bolts 7 are screwed in. Simultaneously, Front Surface 4, at which the Connector Shielding 6 is provided, of Printed Circuit Board Connector 3 is pulled against I/O Plate 1 via Screws 15 [sic] of Mating Connector 13 and Threaded Bolts 7.

What is claimed is:

1. Plug connection between a printed circuit board connector (3) and a mating connector (13), with the printed circuit board connector (3) having a connector shielding (6) styled as a metal shielding plate or a metallizing coating, and an I/O plate (1) with an opening (2) provided between the printed circuit board connector (3) and the mating connector (13) through which printed circuit board connector (3) and mating connector (13) can make contact and can be attached to each other via threaded bolts (7) and screws (16), wherein at least one support device (8, 10, 11, 17) which is in one piece with the I/O plate (1) is provided which, when mating connector (13) is screwed together with printed circuit board connector (3), props mating connector (13) on I/O plate (1), such that connector shielding (6) of printed circuit board connector (3) is pulled against I/O plate (1).

2. Plug connection in accordance with claim 1, wherein threaded bolts (7) are arrayed on printed circuit board connector (3) and screws (16) are arrayed on mating connector (13).

3. Plug connection in accordance with claim 1 wherein printed circuit board connector (3) is of the Sub-D type and has a front surface (4) with a shroud-type projection (5), with both the front surface (4) and the shroud-type projection (5) having a connector shielding (6).

4. Plug connection in accordance with claim 2, wherein threaded bolts (7) of printed circuit board connector (3) are inserted through opening (2) in I/O plate (1).

5. Plug connection in accordance with claim 1, wherein the support device is of the distance piece (8, 10) type, propping itself against I/O plate (1) on the one side and against mating connector (13) on the other side.

6. Plug connection in accordance with claim 5, wherein one distance piece (10) is provided for each threaded bolt (7).

7. Plug connection in accordance with claim 5, wherein one distance piece (8) is provided for both threaded bolts (7) and that it has an insertion opening (9) for making contact between printed circuit board connector (3) and mating connector (13).

8. Plug connection in accordance with claim 5, wherein distance piece (8) or distance pieces (10) are fixed in place in a self-clamping manner upon being set upon threaded bolts (7).

9. Plug connection in accordance with claim 5, wherein the distance piece (8, 10) is made of plastic.

10. Plug connection in accordance with claim 5, wherein the distance piece (8, 10) is made of a conductive material such as metal or conductive plastic.

11. Plug connection in accordance with claim 1, wherein the support device is connected to I/O plate (1).

12. Plug connection in accordance with claim 1, wherein the support device consists of brackets (11) arrayed on the sides of opening (2) in I/O plate (1) and extending at a 90° degree angle.

* * * * *